US005720393A

United States Patent [19]

Wedel et al.

[11] Patent Number: 5,720,393

[45] Date of Patent: Feb. 24, 1998

[54] METHOD AND APPARATUS FOR THE SEPARATION OF MANURE AND SAND

[75] Inventors: Andrew W. Wedel, East Lansing; Blaine F. Severin, Okemos; William G. Bickert, East Lansing, all of Mich.

[73] Assignee: Board of Trustees operating Michigan State University, East Lansing, Mich.

[21] Appl. No.: 621,532

[22] Filed: Mar. 25, 1996

[51] Int. Cl.[6] ..... B03B 7/00

[52] U.S. Cl. ..... 209/13; 209/17; 209/18; 209/172.5; 209/273; 209/461

[58] Field of Search ..... 209/13, 17, 18, 209/44, 170, 172, 173, 172.5, 268, 273, 454, 461, 474

[56] References Cited

U.S. PATENT DOCUMENTS

| | | | |
|---|---|---|---|
| 801,200 | 10/1905 | Bailey | 209/17 X |
| 2,168,942 | 8/1939 | McClave . | |
| 2,530,676 | 11/1950 | Berg et al. | 209/17 X |
| 2,933,187 | 4/1960 | Old et al. . | |
| 4,119,532 | 10/1978 | Park | 209/17 |
| 4,297,208 | 10/1981 | Christian . | |
| 4,324,652 | 4/1982 | Hack . | |
| 4,617,113 | 10/1986 | Christophersen et al. . | |
| 4,851,036 | 7/1989 | Anthes et al. . | |
| 5,368,731 | 11/1994 | Pesotini . | |

OTHER PUBLICATIONS

Handling and Storage Systems For Sand–Laden Dairy Manure From Free Stall Barns, The Proceedings of the Third Inter. Dairy Housing Conf., Dairy Systems for the 21st Century, 1994 ed.

Analysis of a Batch Aerated Grit Ghamber Used to Separate Bedding Sand From Dairy Manure, 1995 ASAE Annual Intl. Meeting Paper No. 95–4705.

*Primary Examiner*—David H. Bollinger

*Attorney, Agent, or Firm*—Ian C. McLeod; Mary M. Moyne

[57] ABSTRACT

A method and apparatus for the separation of manure (104) and sand (102) in a sand and manure mixture (100) is described. The apparatus (10) of the first embodiment includes a tank (12) with an upper grate (22), a lower grate (20), an air supply tube (30) and a water supply tube (36). The apparatus (210) of the second embodiment includes a tank (212) having a screened grate (220), an air supply tube (230) and a water supply tube (236). The apparatus (310) of the third embodiment includes a tank (312) having an upper portion (312C) and a conical lower portion (312D) with a grate (320) between the two portions. In operation, all three embodiments essentially operate similarly. The chamber (12F, 212F and 312F) of the tank is filled with water. The mixture is then dumped into the chamber to form the aqueous suspension (106) with the water. In all three embodiment, the flow of air and water if present, agitates the mixture in the suspension which causes the mixture to break down and the sand to separate from the manure. The sand settles on the floor (12B, 212B and 312B) of the tank while the manure remains suspended in the suspension.

21 Claims, 5 Drawing Sheets

METHOD AND APPARATUS FOR THE SEPARATION OF MANURE AND SAND

BACKGROUND OF THE INVENTION (1) Field of the Invention

The present invention relates to a method and apparatus for the separation of sand and manure from a manure and sand mixture. In particular, the present invention relates to a method and apparatus for separating sand, which is used for bedding animals, such as cows, from the manure in order to allow for easy disposal of the manure and reuse of the sand.

The use of sand as a bedding for animals such as cows has become increasingly more widespread. It has been found that the use of sand as a bedding material for cows has several advantages over the traditionally used chopped straw, sawdust or wood shavings. Some of the benefits are improved udder health, increased cow comfort, cleaner cows, improved traction and lower cost. One drawback to the use of sand is the significant handling and storage problems associated with the resulting manure and sand mixture. The sand in the mixture obstructs the pumps normally used to irrigate the manure suspension onto the surrounding ground surface. Further, when the mixture is filled into pits, the sand eventually settles out of the mixture and fills the pit thus, requiring another pit or excavation of the pit. Either method of disposal is costly which can negate the benefits associated with the use of sand. To allow for easy disposal or storage of the mixture, the manure and sand must be separated. In the past, there was no quick and inexpensive way of separating the manure from the sand.

(2) Description of the Related Art

The related art has shown an assortment of liquid and solid separation systems common to waste water treatment operations as well as the dairy, mining and petroleum refining industries. The publication "Handling and Storage Systems For Sand-Laden Dairy Manure From Free Stall Barns", The Proceedings of the Third International Dairy Housing Conference, Dairy Systems for the 21st Century, 1994 ed. Ray Bucklin, American Society of Agricultural Engineers by some of the inventors describes the current methods of handling sand-laden dairy manure and of separating sand from sand-laden dairy manure. The paper also describes the characteristics of a settled sand profile and provides suggestions for long term handling and storage of sand-laden dairy manure. In addition, the publication, "Analysis of a Batch Aerated Grit Chamber Used to Separate Bedding Sand From Dairy Manure" 1995 ASAE Annual International Meeting Paper No. 95-4705 by the inventors describes several liquid, solid separation techniques and their effectiveness in separating sand from manure in a sand and manure mixture.

Some separation systems such as screening and dissolved air floatation are ineffective for use in separating manure and sand. Screening is ineffective due to the similarities in the particle size distributions of bedding sand and manure. Dissolved air floatation is ineffective because the minute bubbles are unable to float the large, coarse manure particles to the top of the tank for removal. Some other separation systems such as sedimentation and the hydrocyclone are more effective but have disadvantages. Sedimentation is an effective sand separation technique. However, the sand and manure settle out as layers with the manure on top of the sand. The layer of manure on the sand makes removal of the sand difficult without also removing the manure. In addition, dilution rates in excess of 1:1 are required to separate a significant amount of sand from the manure. The separation does not increase for dilution rates greater than 3:1. Hydrocyclones have the potential to be effective sand separators. However, to be effective, the solid feed concentration must remain constant which is difficult to achieve with the manure and sand mixture.

Applications of aeration such as the Pachuca tank and continuous flow aerated grit chambers might also be used to separate sand from manure. However, the prior art does not disclose any such applications using these methods for the stated materials. Pachuca tanks are circular vessels with conical bottoms. Air is introduced at the apex of the conical bottom. The purpose of the conical bottom is to redirect settled solids into the upward flowing fluid so that they may be resuspended. However, because the manure and the sand co-exist in coagulated clumps of a large size, the effectiveness of this technique is reduced. Continuous flow aerated grit chambers consist of either a circular or rectangular concrete tank with air diffusers positioned above the bottom of the tank. The chamber operates as follows: i) influent waste water containing water, organic matter and grit enters the tank; ii) the energy inputted to the water by a continuous air flow creates hydraulic movement of the water; iii) grit settles out while organic material is kept in suspension and carried out of the tank; iv) the accumulated grit is then removed immediately from the tank; and v) effluent containing water and suspended organic matter flows out of the tank. The nature of the energy adsorption into the fluid is crucial to effective grit removal.

The related patent art has also shown various methods and apparatus for separating different materials having different sizes or weights using air and water to provide agitation to separate the materials. Illustrative are U.S. Pat. Nos. 2,933,187 to Old et al; 4,324,652 to Hack and 4,851,036 to Anthes et al.

Old et al describes an apparatus used for the floatation separation of particles, specifically concrete. The apparatus consists of a tank having an inclined bottom along which is mounted a combination agitator and conveyor. Water and air are introduced vertically into the deep end of the tank and the feeding of the material to be separated is downward into the tank opposite the air and water. In the separation process, the lightweight material floats and is discharged over the wall of the tank at the deep end. The heavier particles are moved along the tank upwardly toward the remote end where it is discharged. A removable, vertically oriented screen extends across the tank, intermediate the ends of the tank and prevents the lightweight material from moving with the heavy material toward the shallow end of the tank.

Hack describes a method and apparatus for scrubbing crude oil (bitumen) from tar-sands. The apparatus includes a pair of counter-rotating screw conveyors which tumble the tar-sand so as to rub the grains together and scrub the oil from the sand particles while at the same time moving the progressively cleaner sand toward the discharge end. An air-aspirating venturi underneath the sand lying in the bottom of the cell allows for simultaneously flushing and aerating the sand being tumbled to push the oil particles through the sand and carrying them to the surface.

Anthes et al describes a process and apparatus for separating relatively floatable particulate material from a mixture also having relatively non-floatable, particulate material. The apparatus includes a column with at least one baffle to promote turbulence within the column. Air is introduced into the column below the point of introduction of the mixture to be separated. Water is also added to the column. The rates of introduction of the mixture, air and water and the number and configuration of the baffles must be such as to create a substantial amount of turbulence in the column to keep the relatively floatable particulate matter at the upper portion of the column.

Also of interest is U.S. Pat. No. 4,617,113 to Christophersen et al which shows a floatation separating system. Only of minimal interest are U.S. Pat. Nos. 2,168,942 to McClave; 4,297,208 to Christian and 5,368,731 to Pesotini.

There remains a need for an apparatus which easily and quickly separates the sand from the manure in a manure and sand mixture and which provides reusable sand and sand free manure.

OBJECTS

It is an object of the present invention to provide an apparatus for separating sand from manure in a manure and sand mixture which is quick and inexpensive and which provides reusable sand and an easily handlable manure suspension. Further, it is an object of the present invention to provide a method for separating manure and sand in a manure and sand mixture which is quick and inexpensive and which provides reusable sand and an easily handlable manure suspension. Still further, it is an object of the present invention to provide an apparatus which uses air and water to agitate an aqueous suspension containing the manure and sand mixture in order to separate sand from manure. Further still, it is an object of the present invention to provide an apparatus which uses a grate to help disperse the manure and sand mixture. These and other objects will become increasingly apparent by reference to the following drawings and the description.

DETAILED DESCRIPTION OF THE PREFERRED EMBODIMENT

Figure 1:
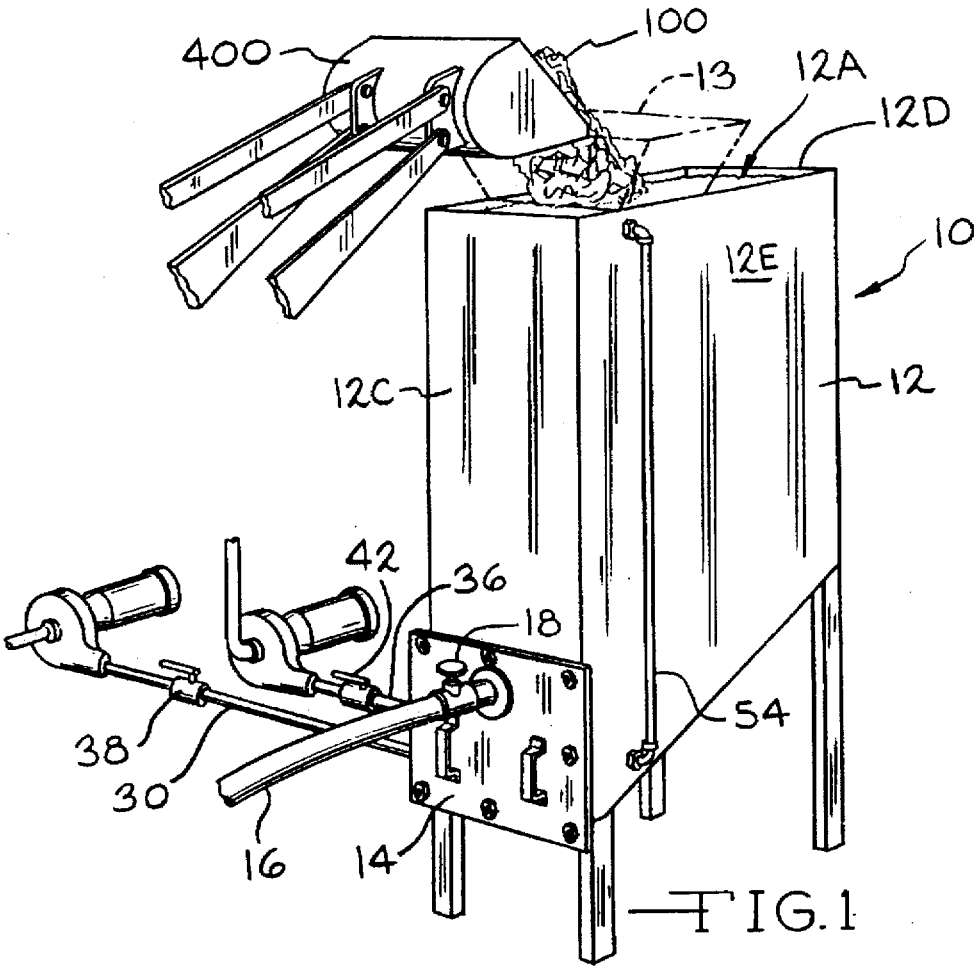
FIG. 1 is a perspective view of the separation apparatus 10 of the first embodiment.

The present invention relates to an apparatus for separating manure from sand in a manure and sand mixture wherein the sand has been used as a bedding for an animal which produces the manure, which comprises: a tank having a top portion spaced above a bottom portion for holding an aqueous suspension into which the manure and sand mixture is fed; a perforate means mounted in the tank between the top and bottom portion of the tank such as to prevent the mixture fed into the top portion of the tank from falling to the bottom portion of the tank; a fluid supply means mounted on the tank for introducing fluid into the tank which agitates the aqueous suspension and separates the manure and the sand from the manure and sand mixture such that the sand passes through the perforate means and the manure is dispersed in the suspension; sand removal means mounted at the lower portion of the tank for removing the sand from the tank; and manure removal means provided on the tank for removing the manure dispersed in the aqueous suspension from the tank after the sand has been separated from the manure.

Further, the present invention relates to a method for separating manure from sand in a manure and sand mixture wherein the sand has been used as a bedding for an animal which produces the manure, which comprises: (i) introducing the manure and sand mixture into an apparatus which comprises: a tank having a top portion spaced above a bottom portion for holding an aqueous suspension into which the manure and sand mixture is fed; a perforate means mounted in the tank between the top and bottom portion of the tank such as to prevent the mixture fed into the top portion of the tank from falling to the bottom portion of the tank; a fluid supply means mounted on the tank for introducing fluid into the tank which agitates the aqueous suspension and separates the manure and the sand from the manure and sand mixture such that the sand passes through the perforate means and the manure is dispersed in the suspension; sand removal means mounted at the lower portion of the tank for removing the sand from the tank; and manure removal means provided on the tank for removing the manure dispersed in the aqueous suspension from the tank after the sand has been separated from the manure; (ii) activating the fluid supply means until most of the sand is in the bottom portion of the tank; and (iii) removing the manure dispersed in the aqueous suspension from the tank through the manure removal means and removing the sand from the tank through the sand removal means.

FIGS. 1 to 6 show the manure and sand separation apparatus 10 of the first embodiment. The apparatus 10 allows for quick and inexpensive separation of the sand 102 from the manure 104 in the manure and sand mixture 100. The first embodiment of the apparatus 10 includes a tank 12, an upper grate 22, a lower grate 20, an air supply tube 30, a water supply tube 36 and a baffle system 24.

The tank 12 preferably has an open top 12A and a sloped floor 12B with a front wall 12C, a back wall 12D and two (2) sidewalls 12E spaced therebetween which form a chamber 12F. The floor 12B of the tank 12 is preferably sloped upward from the front wall 12C to the back wall 12D at an angle of between about 25° and 65° such that the back wall 12D of the tank 12 is shorter than the front wall 12C of the tank 12. The slope of the floor 12B allows for the build up of the sand 102 adjacent the door 14 and the front wall 12C of the tank 12 for easier removal of the sand 102. The front wall 12C of the tank 12 is preferably provided with a door 14 adjacent the floor 12B of the tank 12. The door 14 has an outlet 16 with a valve 18. The valve 18 enables the outlet 16 to be used to remove the aqueous suspension (slurry) 106 containing the manure 104 after the sand 102 has been removed. The outlet 16 preferably has a circular cross-section with at least a 2.0 inch (5.1 cm) diameter such that the aqueous suspension 106 does not clog the outlet 16. The door 14 is sealably mounted over an opening in the front wall 12C of the tank 12 such that the aqueous suspension 106 in the chamber 12F does not leak from the chamber 12F around the union of the door 14 and the front wall 12C. The door 14 is preferably removably mounted over the opening of the front wall 12C such that after the aqueous suspension 106 containing the manure 104 is removed from the chamber 12F, the door 14 is removed to allow removal of the sand 102 from the chamber 12F. The door 14 may also be attached to the front wall 12C of the tank 12 by a hinge (not shown) which allows for easy opening and closing of the door 14. In the first embodiment, the tank 12 is able to handle the sand and manure mixture 100 associated with 10 cows per day with the mixture 100 added as two batches a day. The tank 12 has an essentially rectangular cross-section with a height of 84.0 inches (213.4 cm) from the floor 12B to the open top 12A of the tank 12, a width along the sidewalls 12E of 50.0 inches (127.0 cm) and a length across the front and back walls 12C and 12D of 28.0 inches (71.1 cm). The chamber 12F of the tank 12 is able to hold 390 gallons of the aqueous suspension 106. A fluid indicator 54 is preferably provided on the outside of the tank 12 to allow the user to monitor the level of the suspension 106 in the tank 12.

Figure 3:
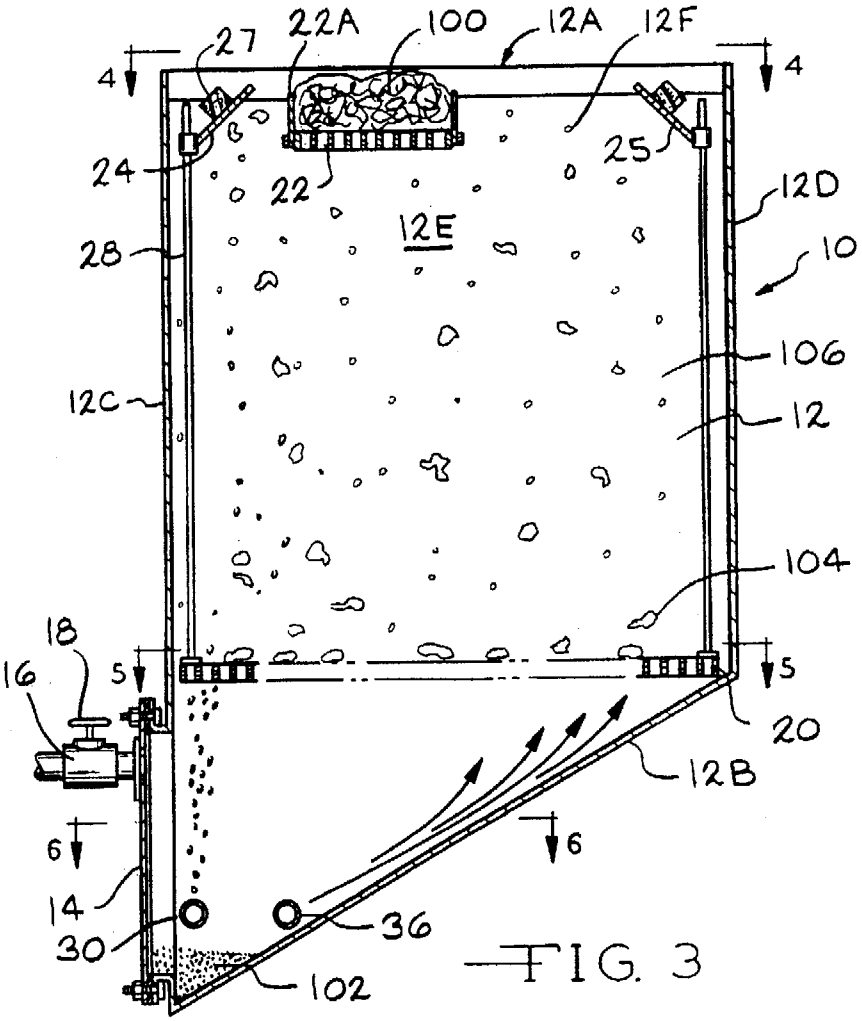
FIG. 3 is a cross-sectional view of the apparatus 10 of FIG. 2 along the line 3—3 showing the upper grate 22, the lower grate 20, the air supply tube 30, the water supply tube 36 and the baffle system 24.
Figure 5:
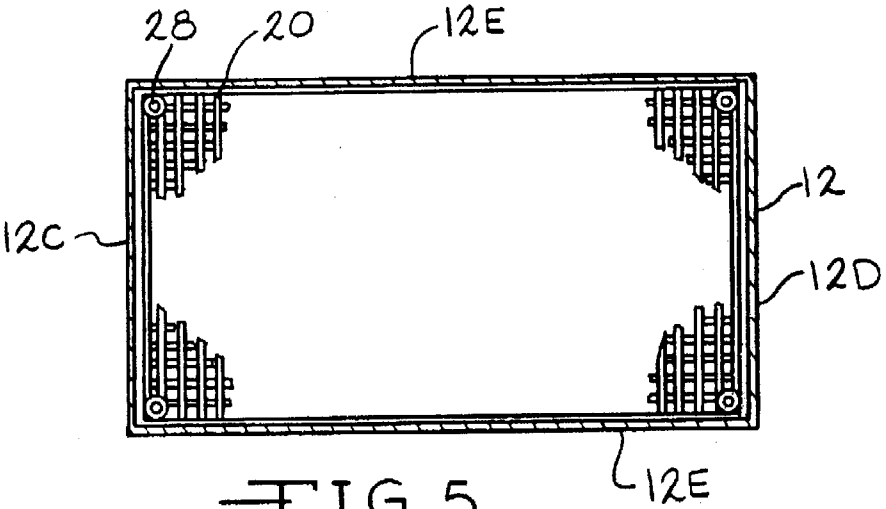
FIG. 5 is a cross-sectional view of the apparatus 10 of FIG. 3 along the line 5—5 showing the lower grate 20.
Figure 6:
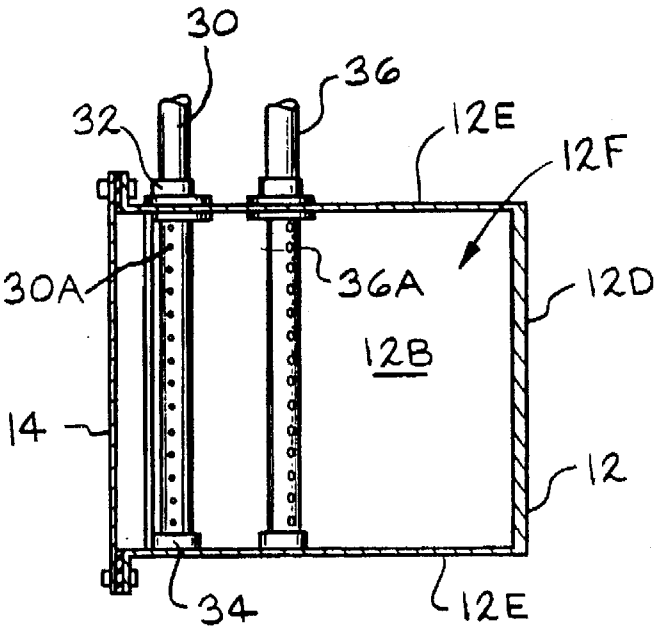
FIG. 6 is a cross-sectional view of the apparatus 10 of FIG. 3 along the line 6—6 showing the air and water tubes 30 and 36 mounted in the chamber 12F.

A lower grate 20 is provided within the chamber 12F of the tank 12 (FIGS. 3 and 5). The grate 20 preferably extends across the entire width and length of the chamber 12F between the open top 12A and the floor 12B of the tank 12. Preferably, the grate 20 is adjacent the intersection of the back wall 12D and the sloped floor 12B and extends perpendicular to the walls 12C, 12D and 12E of the tank 12.

An upper grate 22 is positioned in the chamber 12F adjacent the open top 12A of the tank 12 (FIG. 3). The upper grate 22 is preferably of such a size as to span the entire length of the chamber 12F but not such as to not span across the entire width of the chamber 12F. The upper grate 22 preferably has a width of 14 inches (36 cm). The upper grate 22 is positioned slightly closer to the front wall 12C of the tank 12 than the back wall 12D such that the upper grate 22 is spaced directly above the air supply tube 30 (to be described in detail hereinafter). The upper grate 22 is provided with sides 22A which extend upward toward the top 12A of the tank 12 along the length of the upper grate 22. The sides 22A hold the manure and sand mixture 100 on the upper grate 22. The grates 20 or 22 preferably have mesh openings about 0.50 inch (1.27 cm) or have parallel spaced bars (not shown) about 1.0 inch (2.54 cm) apart. The size of the mesh openings or spacing of the bars of the grates 20 and 22 will depend upon the consistency and composition of the manure and sand mixture 100.

Figure 15:
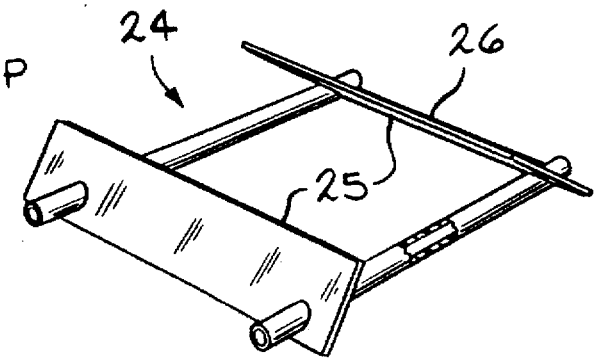
FIG. 15 is a view of the baffle system 24 of the first embodiment having the floatation blocks 27 on the baffle plates 25.

The chamber 12F is provided with a baffle system 24 which includes plates 25 which extend along the front wall 12C and the back wall 12D of the tank 12 (FIGS. 3 and 15) and floatation tubes 26 which connect the ends of the plates 25 together and which extend along the sides 12 of the tank 12. The tubes 26 hold the plates 25 at approximately a 45° angle. The floatation tubes 26 are preferably hollow tubes constructed of a durable, lightweight material such as PVC which are sealed at both ends with air trapped in the tubes 26. The trapped air allows the baffle system 24 to float at the top of the aqueous suspension 106. In an alternate embodiment, the baffle plates 25 of the system 24 have floatation blocks 27 such as polystyrene blocks mounted to the top side of the plates 25 which allow the baffle system 24 to float at the top of the aqueous suspension 106 in the tank 12 (FIG. 3). The plates 25 are slidably mounted on shafts 28 which extend upward from the lower grate 20 through each end of the plates 25. In either embodiment, preferably the baffle system 24 is able to move between the lower grate 20 and the upper grate 22. The exact height of the baffle system 24 will necessarily depend upon the level of the aqueous suspension 106 in the chamber 12F.

Figure 2:
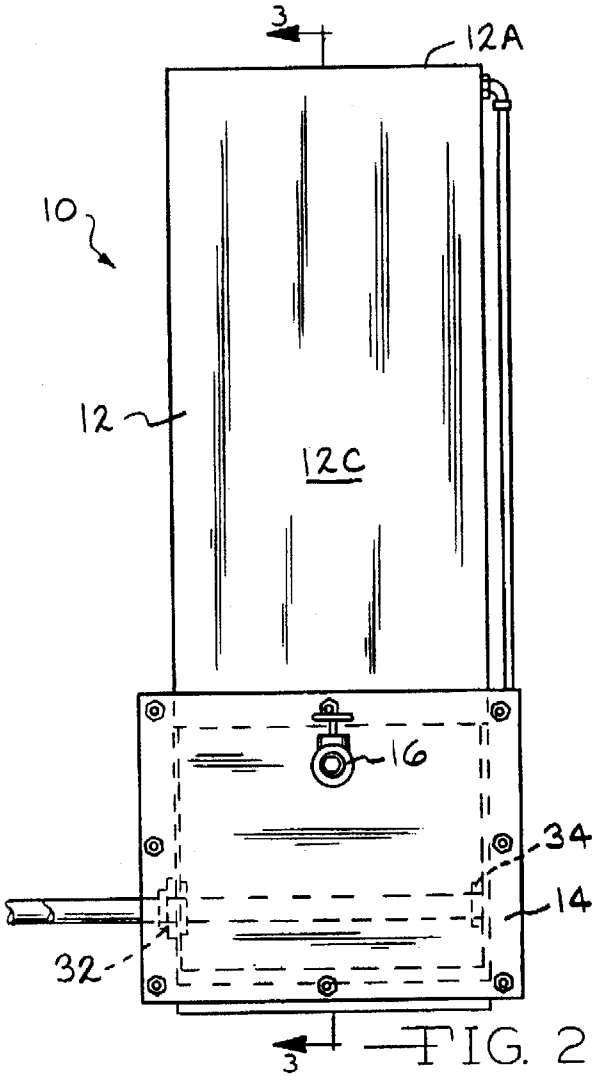
FIG. 2 is a front view of the apparatus 10 of FIG. 1.
Figure 4:
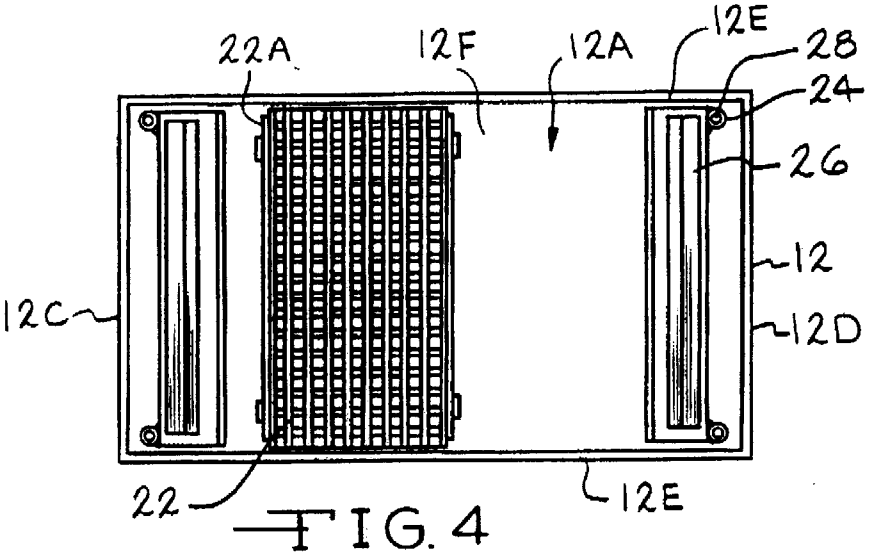
FIG. 4 is a top view of the apparatus 10 of FIG. 3 along the line 4—4 showing the upper grate 22 and the baffle system 24.

An air supply tube 30 and a water supply tube 36 are provided adjacent the floor 12B of the tank 12 (FIG. 3). The air supply tube 30 is preferably positioned adjacent the front wall 12C of the tank 12 above the floor 12B of the tank 12. The water supply tube 36 preferably extends across the length of the tank 12 between the sidewalls 12E. In the first embodiment, the air tube 30 is held in place on one of the sidewalls 12E of the tank 12 by a bracket 32 and extends outward to and through an opening in the other sidewall 12E of the tank 12. A sealing ring 34 is mounted around the tube 36 at the opening in the sidewall 12E and prevents the aqueous suspension 106 in the chamber 12F from leaking through the opening (FIG. 2). The air tube 30 is preferably able to be easily removed from the tank 12 to allow repair of the tube 30. The orifices 30A are provided opposite the floor 12B and allow for uniform dispersion of the air across the tank 12. The direction in which the air travels upward through the water in the chamber 12F is in part due to the current in the tank 12 created by the previous air bubbles. The current causes the air to move upward and across the tank. The direction of travel of the air is also influenced by the baffle system 24. The placement of the orifices 30A may be varied. In the first embodiment, the tube 30 has a diameter of 0.75 inches (1.91 cm) and the orifices 30A have a diameter of 0.063 inches (0.16 cm). The air tube 30 is connected to an air valve 38 on the outside of the tank 12. The air valve 38 is provided with a meter (not shown) to allow the user to determine the amount of air being injected into the tank 12. The air in the air tube 30 preferably has a pressure sufficient to overcome static and dynamic pressure losses and to thus provide equivalent flow through each orifice 30A of the air tube 30. In the first embodiment, the pressure is preferably 10 PSI. The air supply for the air tube 30 is preferably a compressor (not shown) however, any type of air supply may be used. In the first embodiment, the air tube 30 provides about 8 CFM into the tank 12.

The water tube 36 is preferably spaced apart from the air tube 30 toward the back wall 12D of the tank 12. The water tube 36 is preferably mounted similarly to the air tube 30 between the sidewalls 12E of the tank 12. The water tube 36 also has orifices 36A however, the orifices 36A of the water tube 36 are preferably spaced in the sides of the tube 36 such that the water exiting the tube 36 is tangent to the sloped floor 12B of the tank 12 (FIG. 3). In the first embodiment, the water tube 36 has a diameter of 0.75 inches (1.91 cm) and provides about 5 gal/min of water into the tank 12. The water tube 36 is connected to a water valve 42 and meter (not shown) to allow the user to vary the amount of water entering the tank 12. The water supply is of any type such as a direct hook up to the water supply for a building (not shown) housing the tank 12 or to a pond (not shown).

Figure 7:
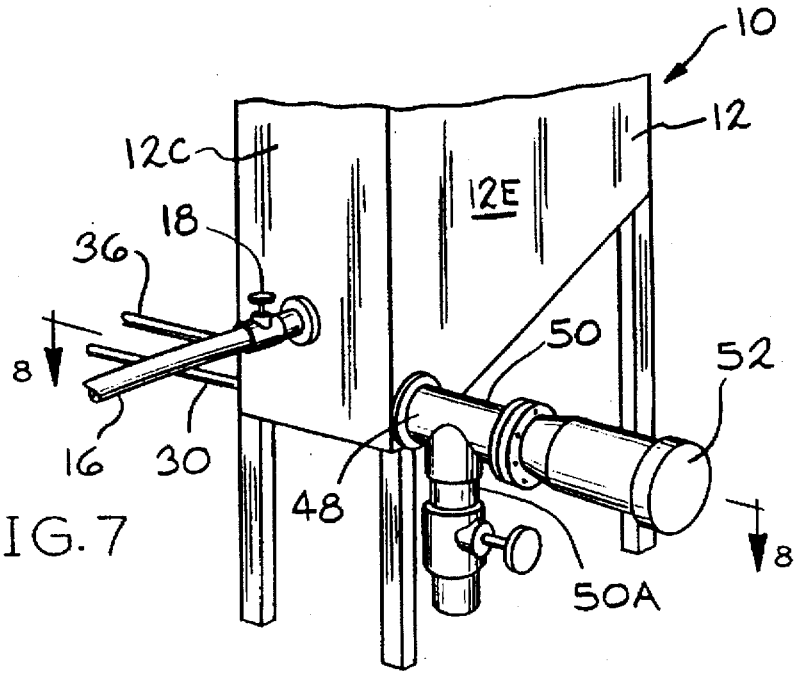
FIG. 7 is a partial, perspective view of the apparatus 10 of the first embodiment showing the screw conveyor 48.
Figure 8:
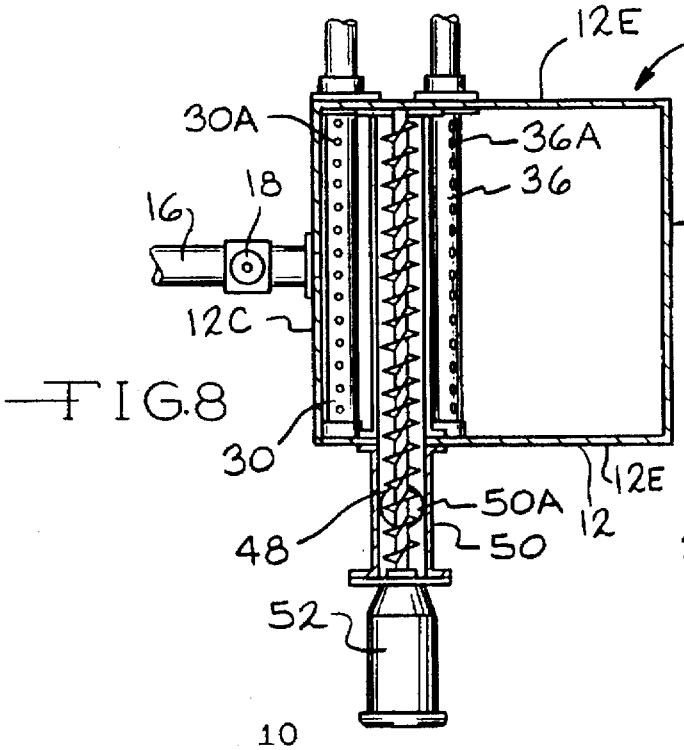
FIG. 8 is a cross-sectional view of the apparatus 10 of FIG. 7 along the line 8—8 showing the screw conveyor 48 spaced below the water and air tubes 36 and 30.

In an alternate embodiment as shown in FIGS. 7 and 8, the slope of the tank 12 is provided with a screw conveyor 48. The screw conveyor 48 is preferably mounted adjacent the front wall 12C of the tank 12. Preferably, the screw conveyor 48 does not extend upward such a distance as to interfere with the water and air tubes 36 and 30. The screw conveyor 48 extends from one sidewall 12E of the tank 12 and through the other sidewall 12E of the tank 12. In the first embodiment, the screw conveyor 48 extends out the sidewall 12E opposite to the sidewall 12E through which the air and water tubes 30 and 36 extend. As the screw conveyor 48 extends beyond the tank 12, the conveyor 48 is preferably surrounded by a cover 50. The conveyor motor 52 is mounted at the end of the cover 50 opposite the sidewall 12E. The bottom of the cover 50 has an outlet 50A between the sidewall 12E and the conveyor motor 52 which allows the sand 102 moved out of the tank 12 by the conveyor 48 to be removed from the conveyor 48. The cover 50 for the conveyor 48 preferably prevents leakage of the aqueous suspension 106 and the sand 102 out of the tank 12 except through the outlet 50A. In an alternate embodiment (not shown), the conveyor 48 is located below the floor 12B of the tank 12 such that the conveyor 48 is the lowest portion of the tank 12. The screw conveyor 48 may also be angled along the floor 12B of the tank 12 such that sand 102 is collected along the entire width of the tank 12. The sand 102 is then carried upward out the back wall 12D of the tank 12. The screw conveyor 48 is preferably similar to screw conveyors well known in the art.

Figure 11:
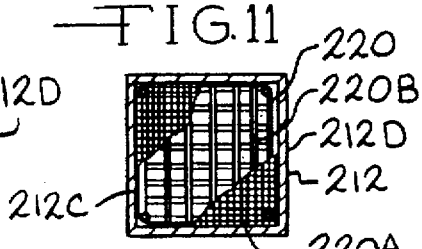
FIG. 11 is a cross-sectional top view of the apparatus 210 of FIG. 10 along the line 11—11 showing the screened grate 220.
Figure 9:
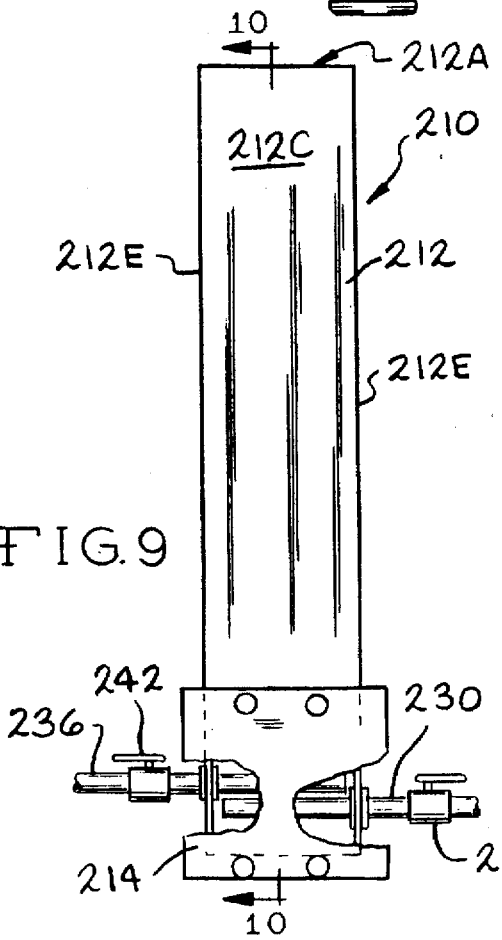
FIG. 9 is a front view of the apparatus 210 of the second embodiment with cutout portions showing the air tube 230 and the water tube 236.
Figure 10:
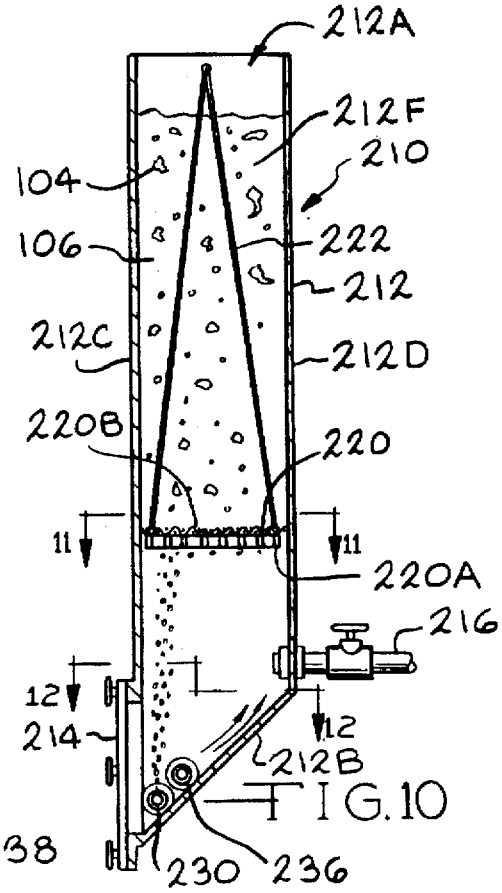
FIG. 10 is a cross-sectional side view of the apparatus 210 of FIG. 9 along the line 10—10 showing the screened grate 220.

In a second embodiment, as shown in FIGS. 9 to 12, the tank 212 is similar in shape to the tank 12 of the first embodiment. The floor 212B is preferably sloped at a 45° angle. In the second embodiment, the aqueous suspension outlet 216 is provided in the back wall 212D of the tank 212 adjacent the floor 212B. The tank 212 has an adjustable screened grate 220 (FIG. 11). The screened grate 220 includes a screen 220A and a grate 220B which are preferably mounted together. The screened grate 220 is mounted in the chamber 212F such that the screen 220A is spaced above the grate 220B below the open top 212A of the tank 212. The screened grate 220 is preferably mounted by chains 222 or cables which are connected at one end to the sidewalls 212E of the tank 212 adjacent the open top 212A and at the other end to the screened grate 220 (FIG. 10). The chains 222 allow the height of the screened grate 220 to be adjusted such as to vary the distance between the screened grate 220 and the water and air supply tubes 236 and 230. The screened grate 220 is preferably the same shape as the cross-section of the tank 212. The screened grate 220 is preferably of such a size such as to easily move up and down within the chamber 212F and to be closely adjacent to all the walls 212C, 212D and 212E of the tank 212 to prevent the mixture 100 from passing between the screened grate 220 and the walls 212C, 212D and 212E of the tank 212. The screen 220A preferably has mesh openings of approximately 0.50 inch (1.27 cm). The grate 220B preferably has bars spaced approximately about 1.0 inch (2.54 cm) apart.

In the second embodiment, the air and water tubes 230 and 236 are mounted parallel to the sloped floor 212B of the tank 212 with the air tube 230 spaced in front of and below the water tube 236 adjacent the door 14 (FIGS. 9 and 10). The water and air tubes 236 and 230 extend through opposite sidewalls 212E and the valves 238 and 242 are mounted adjacent the opposite sidewalls 212E of the tank 212. The positioning of the valves 238 and 242 and the mounting of the air and water tubes 230 and 236 through the sidewalls 212E depend upon the particular design of the tank 212. The size of the air and water tubes 230 and 236 are preferably similar to those of the first embodiment and preferably the pressure of the air and water entering the tank 212 are similar to those of the first embodiment. The size and position of the orifices 236A and 230A in the water and air tubes 236 and 230 are similar to the first embodiment with the air orifices 230A in the top of the air tube 230 and the water orifices 236A in the side of the water tube 236 aimed tangent to the floor 212B.

Figure 12:
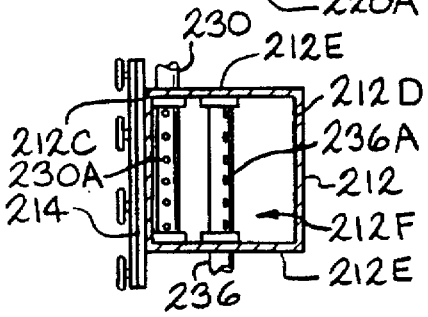
FIG. 12 is a cross-sectional top view of the apparatus 210 of FIG. 10 along the line 12—12 showing the air tube 230 and the water tube 236, mounted on the chamber 212F.
Figure 13:
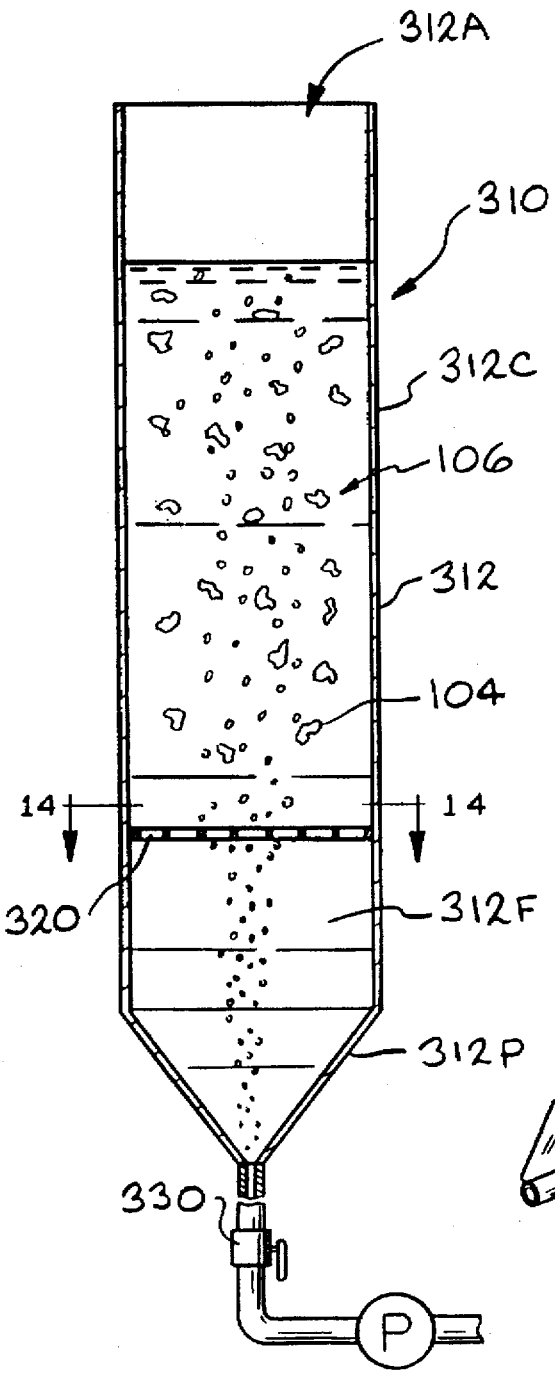
FIG. 13 is a cross-sectional front view of the apparatus 310 of the third embodiment showing the grate 320 and the air inlet 330 in the bottom of the chamber 312F.
Figure 14:
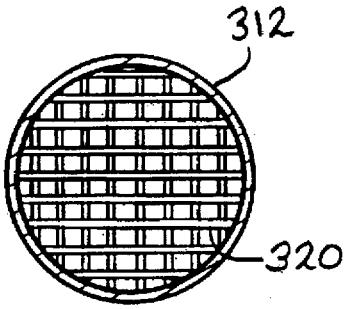
FIG. 14 is a cross-sectional top view of the apparatus 310 of FIG. 13 along the line 14—14 showing the grate 320.

FIGS. 13 and 14 show the apparatus 310 of the third embodiment of the present invention. As shown in FIG. 12, the tank 312 of the third embodiment has a cylindrical upper portion 312C with a conical lower portion 312D. The air inlet 330 is provided in the apex of the conical lower portion 312D of the tank 312. The air inlet 330 has a single orifice which forces air upward toward the top 312A of the tank 312. The tank 312 is preferably similar to the Pachuca tank of the related art. However, unlike the Pachuca tank, the tank 312 of the third embodiment is provided with a grate 320 mounted in the upper portion 312C of the tank 312 and extending across the entire cross section of the tank 312. The grate 320 acts to slow the descent of the mixture 100 to the bottom of the tank 312. This added holdup time allows sufficient contact between the mixture 100 and the moving, aqueous suspension 106 to erode the mixture 100 into small particles. The mixture 100 then enters the lower portion 312D of the tank 312 in a dispersed form. Dispersion of the particles in the mixture 100 allows the flow of air from the air inlet 330 to effectively act on the mixture 100 to separate the sand 102 from the manure 104 in the mixture 100. The grate 320 is preferably similar to the lower grate 20 of the first embodiment. A door (not shown) may be provided on the lower portion 312D of the tank 312 for removal of the sand 102. An outlet (not shown) is also provided in the lower portion 312D of the tank 312 to allow for removal Of the aqueous suspension 106.

In all three of the embodiments, the tank 12, 212 and 312 is preferably constructed of steel however, any suitable material could be used. The grates 20, 22, 220 and 320 of all three embodiments are preferably constructed of steel however, other materials such as nylon or plastic could also be used.

IN USE

In general, all three embodiments operate similarly and use a batch operation. Preferably, water is first added to the tank 12, 212 or 312 to the level of the lower grate 20 in the first embodiment or to the screened grate 220 or grate 320 in the second and third embodiments. The air flow is then activated to establish a stable circulation pattern in the added water. The air flow rate is pre-adjusted such that the established currents in the suspension 106 allow for deposition of the sand 102 to the bottom of the tank 12, 212 or 312, but do not allow for deposition of manure 104 contained in the suspension 106. The position of the air tube 30 or 230 or air inlet 330, the direction of air flow, the position of the baffle system 24 (if present) and the geometry of the tank 12, 212 or 312 all affect the currents established in the water. Next, a batch of the manure and sand mixture 100 is fed through the open top 12A, 212A or 312A of the tank 12, 212 or 312 into the chamber 12F, 212F or 312F. The mixture 100 may be provided into the open top 12A, 212A or 312A in several ways. The mixture 100 may be dumped into the open top 12A, 212A or 312A using a front end loader 400 to move the mixture 100 into a bin 13 situated over the top 12A, 212A or 312A of the tank 12 (FIG. 1). The mixture 100 may also be slowly fed into the tank 12, 312 or 312 by means of a conveyor (not shown) or a pump (not shown). The amount of mixture 100 able to be handled by the apparatus 10, 210 or 310 will depend upon the size of the tank 12, 212 or 312.

In the first embodiment, the mixture 100 is fed into the open top 12A of the tank 12 onto the upper grate 22 (FIG. 1). The sides 22A of the grate 22 allow the mixture 100 to be piled onto the upper grate 22 without the mixture 100 falling off the grate 22. The upper grate 22 prevents clogging of the apparatus 20 by slowly metering the mixture 100 into the chamber 12F during the batch process. In the first embodiment, a batch of mixture 100 is approximately about 440 lbs. which represents about 99 lbs. of sand 102 and 341 lbs. of manure 104. The batch preferably represents one half of the amount of mixture 100 resulting from the use of sand 102 as bedding for 10 cows for one (1) day. Preferably, two batches of mixture 100 are run through the apparatus 10, 210 or 310 per day.

In the second embodiment, the mixture 100 is dropped directly onto the screened grate 220. The screened grate 220 prevents the mixture 100 from dropping directly to the bottom 212B of the tank 212. The smaller mesh of the screen 220A in the second embodiment prevents the clumps or particles of the mixture 100 from passing through the screened grate 220 until the particles are smaller than the mesh of the screen 220A.

In the third embodiment, the mixture 100 is dropped on the grate 320 which prevents the manure and sand mixture 100 from immediately settling in the lower portion 312D of the tank 312 which prevents clogging of the air inlet 330 and enables the mixture 100 to be acted on by the flow of air from the air inlet 330.

The dispersed mixture 100 then becomes a portion of the aqueous suspension 106. The dispersed particles of mixture 100 are aggressively mixed in the established current wherein the sand 102 becomes separated from the manure 104. More water is then added to the tank 12, 212 or 312. As the water level rises, aggressive erosion of the sand and manure mixture 100 remaining on the grate 20, 220 or 320 begins.

In the first and second embodiments, the air and water continue to act on the layer of sand 102 forming on the floor 12B or 212B of the tank 12 or 212. The placement of the air and water tubes 30, 230, 36 and 236 enables the tubes 30, 230, 36 and 236 to be within the layer of sand 102. The air and water act in concert to create rapidly opening and closing channels within the layer of sand 102. Preferably, the air creates an open channel and the fresh water collapses the air generated channel. This has two effects. First, the opening and closing of the channels by the air and water allow free paths for any manure 104 which have become entrapped in the layer of sand 102 and allow the manure 104 to be lifted by the nature of buoyant forces away from the layer of sand 102. Second, the air and water movement allows for erosion and subsequent movement of the sand 102 towards the floor 12B or 212B of the tank 12 or 212 for removal. The cleaning of the manure 104 from the settled sand 102 and the movement of the sand 102 towards the floor 12B or 212B of the tank 12 and 212 are unexpected benefits of the apparatus 10 and 210. The slow addition of fresh water below the layer of sand 102 in the tank 12 or 212 also acts to cleanse the sand 102 of organic material as well as to dilute any organics in suspension located between the particles of sand 102. The rising, circulated water and the grate 20 and 220 act in concert to allow the slow erosion and dispersement of the mixture 100 into the aqueous suspension 106.

In the third embodiment, the air inlet 330 acts similarly to the air tubes 30 and 230 of the first and second embodiments and operates to separate the sand 102 from the manure 104 in the mixture 100 such that the sand 102 settles in the lower portion 312D of the tank 312 while the manure 104 remains suspended as part of the aqueous suspension 106.

The separation process is initially completed when the tank 12, 212 or 312 is completely filled with water. In the first embodiment, it takes approximately 15 minutes for the water level in the tank 12 to reach the full level which is approximately about 4.0 inches (10.2 cm) from the top 12A of the tank 12 or level with the tops of the sides 22A of the upper grate 22. At this point, the water is shut off. The baffle system 24 preferably floats at the top of the aqueous suspension 106, level with the upper grate 22 (FIG. 3). Air may be continued to be added for a time after the tank 12 is full to keep the manure 104 from settling onto the layer of sand 102 and may be used to better cleanse the sand 102 for aesthetic reasons. In the first embodiment, the air tube 30 is left "on" for about another 10 minutes and continues to aerate the aqueous suspension 106 to allow the sand 102 to settle out of the suspension 106.

In an alternative mode, fresh water may be continued to be added for as long as desired, with continuous overflow of aqueous suspension 106 containing the manure 104 from a point near the top 12A, 212A or 312A of the tank 12, 212 or 312. This will produce very clean sand 102 and very dirty or manure 104 rich aqueous suspension 106.

Once the sand 102 has settled out of the suspension 106, the separation of the mixture 100 is complete. The aqueous suspension 106 containing the manure 104 is then removed from the tank 12, 212 or 312 preferably, through the outlet 16 or 216. The sand 102 is either removed manually such as through the door 14 or 214 located adjacent to the floor 12B or 212B of the tank 12 or 212. The aqueous suspension 106 which contains the manure 104, may then be used to fertilize and irrigate using conventional, well known methods and apparatuses for spreading fertilizer. In the first embodiment, for a batch containing 440 lbs. of the manure and sand mixture 100, approximately 95 lbs. of sand 102 are removed. The sand 102 which is removed from the tank 12, 212 or 312 preferably contains less than 2% organic matter.

In the alternative embodiment having the conveyor 48, once the sand 102 has settled out of aqueous suspension 106, the sand 102 is removed by the conveyor 48 while the aqueous suspension 106 containing the manure 104 remains in the tank 12. Once the sand 102 is removed, the air is shut off and the manure 104 is allowed to settle out of the aqueous suspension 106. A thickened manure suspension (slurry) may then be removed via the conveyor 48 and a very dilute aqueous suspension 106 removed by the outlet 16.

It is intended that the foregoing description be only illustrative of the present invention and that the present invention be limited only by the hereinafter appended claims.

We claim:

1. An apparatus for separating manure from sand in a manure and sand mixture wherein the sand has been used as a bedding for an animal which produces the manure, which comprises:

(a) a tank having a top portion spaced above a bottom portion for holding an aqueous suspension into which the manure and sand mixture is fed;

(b) a perforate means mounted in the tank between the top and bottom portion of the tank such as to prevent the mixture fed into the top portion of the tank from rapidly falling to the bottom portion of the tank;

(c) a fluid supply means mounted on the tank for introducing fluid into the tank which agitates the aqueous suspension and separates the manure and the sand from the manure and sand mixture such that the sand passes through the perforate means and the manure is dispersed in the suspension;

(d) sand removal means mounted at the lower portion of the tank for removing the sand from the tank; and (e) manure removal means provided on the tank for removing the manure dispersed in the aqueous suspension from the tank after the sand has been separated from the manure.

2. The apparatus of claim 1 wherein the lower portion of the tank has a sloped floor.

3. The apparatus of claim 2 wherein the sloped floor has a slope of between 25° and 65°.

4. The apparatus of claim 2 wherein the fluid supply means is mounted below the perforate means adjacent a lowest portion of the floor of the tank.

5. The apparatus of claim 2 wherein the fluid supply means introduces the fluid in a direction tangent to the floor of the tank.

6. The apparatus of claim 5 wherein the fluid is water.

7. The apparatus of claim 1 wherein the fluid supply means is a pair of conduits extending across a length of the tank parallel to the floor of the tank.

8. The apparatus of claim 1 wherein the perforate means includes a screen mounted above a grate as the perforate means.

9. The apparatus of claim 8 wherein the screen has a mesh of about 0.25 to 0.75 inch (0.64 to 1.91 cm) and the grate has bars spaced about 1.00 inch (2.54 cm) apart.

10. The apparatus of claim 1 wherein a pair of baffles are movably positioned adjacent opposite sides of the top portion of the tank at a fluid level of the aqueous suspension which acts to promote a current in the aqueous suspension in the tank as a result of the introduction of the fluid.

11. The apparatus of claim 1 wherein the sand removal means is a conveyor means which removes the sand from the lower portion of the tank.

12. The apparatus of claim 11 wherein the conveyor means is a screw conveyor.

13. The apparatus of claim 1 wherein the fluid supply means includes an air supply means and a water supply means.

14. The apparatus of claim 1 wherein the fluid is air.

15. The apparatus of claim 10 wherein the baffles include angled plates connected together by hollow tubes having air trapped inside.

16. A method for separating manure from sand in a manure and sand mixture wherein the sand has been used as a bedding for an animal which produces the manure, which comprises:

(a) introducing the manure and sand mixture into an apparatus which comprises: a tank having a top portion spaced above a bottom portion for holding an aqueous suspension into which the manure and sand mixture is fed; a perforate means mounted in the tank between the top and bottom portion of the tank such as to prevent the mixture fed into the top portion of the tank from falling rapidly to the bottom portion of the tank; a fluid supply means mounted on the tank for introducing fluid into the tank which agitates the aqueous suspension and separates the manure and the sand from the manure and sand mixture such that the sand passes through the perforate means and the manure is dispersed in the aqueous suspension; sand removal means mounted at the lower portion of the tank for removing the sand from the tank; and manure removal means provided on the tank for removing the manure dispersed in the aqueous suspension from the tank after the sand has been separated from the manure;

(b) activating the fluid supply means until most of the sand is in the bottom portion of the tank; and (c) removing the manure dispersed in the aqueous suspension from the tank through the manure removal means and removing the sand from the tank through the sand removal means.

17. The method of claim 16 wherein the fluid supply means is activated before the manure and sand mixture is introduced into the tank.

18. The method of claim 16 wherein the fluid supply means is deactivated before the sand and the manure liquid suspension are removed.

19. The method of claim 16 wherein the manure in the aqueous suspension which is removed and is applied to soil as fertilizer.

20. The method of claim 16 wherein the sand which is removed is reused as animal bedding.

21. The method of claim 16 wherein the animal is a bovine.

* * * * *